US007117933B2

(12) United States Patent
Iwasaki et al.

(10) Patent No.: US 7,117,933 B2
(45) Date of Patent: Oct. 10, 2006

(54) CORE STRUCTURE OF INTEGRAL HEAT-EXCHANGER

(75) Inventors: Mitsuru Iwasaki, Kanagawa (JP); Kazunori Namai, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/234,139

(22) Filed: Sep. 26, 2005

(65) Prior Publication Data

US 2006/0016585 A1 Jan. 26, 2006

Related U.S. Application Data

(62) Division of application No. 10/097,422, filed on Mar. 15, 2002, now Pat. No. 6,957,694.

(30) Foreign Application Priority Data

Mar. 16, 2001 (JP) ..... 2001-075469

(51) Int. Cl.
*F28D 1/02* (2006.01)
*F28F 13/00* (2006.01)

(52) U.S. Cl. ..... 165/152; 165/140; 165/181

(58) Field of Classification Search ..... 165/140, 165/151, 152, 181, 182, 135
See application file for complete search history.

(56) References Cited

U.S. PATENT DOCUMENTS

| | | | | |
|---|---|---|---|---|
| 3,003,749 | A * | 10/1961 | Morse | 165/152 |
| 4,328,861 | A | 5/1982 | Cheong et al. | |
| 4,615,384 | A | 10/1986 | Shimada et al. | |
| 4,693,307 | A * | 9/1987 | Scarselletta | 165/152 |
| 5,033,540 | A | 7/1991 | Tategami et al. | |
| 5,289,874 | A | 3/1994 | Kadle et al. | |
| 5,669,438 | A | 9/1997 | Beales et al. | |
| 5,992,514 | A | 11/1999 | Sugimoto et al. | |
| 6,209,628 | B1 | 4/2001 | Sugimoto et al. | |
| 6,273,184 | B1 | 8/2001 | Nishishita | |
| 6,354,368 | B1 * | 3/2002 | Nishishita et al. | 165/135 |
| 6,357,518 | B1 * | 3/2002 | Sugimoto et al. | 165/140 |
| 6,543,527 | B1 * | 4/2003 | Bouzida et al. | 165/152 |
| 6,805,193 | B1 * | 10/2004 | Hu et al. | 165/181 |
| 6,837,304 | B1 * | 1/2005 | Makino et al. | 165/135 |
| 2001/0035284 | A1 | 11/2001 | Iwasaki et al. | |
| 2003/0075307 | A1 * | 4/2003 | Stoynoff et al. | 165/135 |

FOREIGN PATENT DOCUMENTS

| | | |
|---|---|---|
| EP | 0 826 942 A2 | 3/1998 |
| EP | 1 167 909 A2 | 1/2002 |
| EP | 1 193 460 A2 | 4/2002 |
| FR | 2 785 978 A1 | 5/2000 |
| JP | 63-163785 A | 7/1988 |
| JP | 10-009783 A | 1/1998 |

(Continued)

*Primary Examiner*—Tho Duong
(74) *Attorney, Agent, or Firm*—Foley Lardner LLP

(57) ABSTRACT

A corrugated fin comprises a first part which is interposed between paired first tubes, a second part which is interposed between paired second tubes and a third part through which the first and second parts are integrally connected. The third part of the corrugated fin is formed with louvers which extend in a direction perpendicular to upper and lower folded edge portions of the first and second parts. Each of the louvers is of a half-louver type including an elongate flat portion which is bent up or down along a lower edge thereof from a major portion of the third part and two generally triangular supporting portions which support longitudinal ends of the elongate flat portion from the major portion.

6 Claims, 5 Drawing Sheets

FOREIGN PATENT DOCUMENTS

JP 2000-220983 A 8/2000

WO WO 99/53253 A1 10/1999

* cited by examiner

CORE STRUCTURE OF INTEGRAL HEAT-EXCHANGER

The present application is a divisional of U.S. application Ser. No. 10/097,422, filed Mar. 15, 2002 now U.S. Pat. No. 6,957,694, the entire contents of which are incorporated herein by reference.

BACKGROUND OF THE INVENTION

1. Field of the Invention

The present invention relates to a core structure of an integral heat-exchanger in which corrugate fins of a first heat-exchanger and those of a second heat-exchanger are integral with one another.

2. Description of Related Art

A core structure of an integral heat-exchanger is shown in Laid-open Japanese Patent Application (Tokkai-hei) 10-9783. For clarifying the present invention, the core structure of the publication will be briefly described with reference to FIGS. 6, 7 and 8 of the accompanying drawings.

As is seen from FIG. 6 which shows a sectional view of a part of the integral heat-exchanger, the core structure 100 generally comprises first parallel flat tubes 1 (only two are shown), second parallel flat tubes 2 (only two are shown) which are positioned behind the first tubes 1 and a plurality of corrugated fins 3 (only one is shown) each of which comprises a front part 3*a* interposed at upper and lower folded edge portions thereof between paired two of the first tubes 1, a rear part 3*b* interposed at upper and lower folded edge portions thereof between paired two of the second tubes 2 and a center part 3*c* through which the front and rear parts 3*a* and 3*b* are integrally connected. When in use, the core structure 100 is arranged so that the first tubes 1 are in front of the second tubes 2 with respect to a direction of air flow that is produced when an associated motor vehicle runs. (For ease of description, such air flow will be called "running air flow" in the following description.) That is, the first tubes 1 are those through which a refrigerant running in a cooling system of an automotive air conditioner flows to be cooled and the second tubes 2 are those through which an engine cooling water from a water jacket of an associated engine flows to be cooled. Usually, the second tubes 2 are much heated as compared with the first tubes 1.

The front and rear parts 3*a* and 3*b* of the corrugated fins 3 are each formed with plurality of louvers 3*a'* and 3*b'* for improving heat radiation effect of the core structure 100.

As is seen from FIGS. 6 and 7, the center part 3*c* of the corrugated fins is formed with parallel louvers 3*e*. Each louver 3*e* comprises a fully raised elongate flat portion 3*h* which is parallel with a major flat portion of the center part 3*c*. Due to provision of the parallel louvers 3*e*, a heat transfer between the first and second tubes 1 and 2, particularly the heat transfer from the highly heated second tubes 2 toward the less heated first tubes 1 is obstructed.

However, hitherto, producing the corrugated fins 3 with such parallel louvers 3*e* has needed a skilled and thus expensive punching technique because of the following reasons. That is, as is seen from FIGS. 7 and 8, the parallel louvers 3*e* are produced by punching a corresponding part (viz., center part 3*c*) of the corrugated fin 3. With this punching, the corresponding part is cut and partially raised up to produce bridge-like louvers 3*e* each including the elongate flat portion 3*h* and two rectangular supporting portions 3*i*. Due to the nature of the punching, upon punching, portions which are to be formed into the rectangular supporting portions 3*i* are considerably expanded. Thus, if the supporting portions 3*i* are positioned extremely close to folded edge portions 3*j* of the corrugated fin 3 that are also considerably expanded, cracks 3*k* tend to appear at the bent portions 3*j* as is seen from FIG. 8. Thus, hitherto, it has been difficult to provide the parallel louvers 3*e* with a sufficient length "L1". Of course, a satisfied heat transfer obstruction is not expected when the parallel louvers 3*e* fail to have a sufficient length "L1".

SUMMARY OF THE INVENTION

It is therefore an object of the present invention to provide a core structure of an integral heat-exchanger, which is free of the above-mentioned drawbacks.

According to a first aspect of the present invention, there is provided a core structure of an integral heat-exchanger, which comprises at least two first tubes which extend in parallel with each other; at least two second tubes which extend in parallel with each other, the second tubes being juxtaposed with the first tubes; and a corrugated fin including a first part which is interposed at upper and lower folded edge portions thereof between the first tubes, a second part which is interposed at upper and lower folded edge portions between the second tubes and a third part through which the first and second parts are integrally connected, the third part of the corrugated fin being formed with louvers which extend in a direction perpendicular to the upper and lower folded edge portions of the first and second parts, each of the louvers being of a half-louver type including an elongate flat portion which is bent up or down along a longer edge thereof from a major portion of the third part and two generally triangular supporting portions which support longitudinal ends of the elongate flat portion from the major portion.

According to a second aspect of the present invention, there is provided a core structure of an integral heat-exchanger, which comprises at least two flat first tubes which extend in parallel with each other; at least two flat second tubes which extend in parallel with each other, the second tubes being juxtaposed with the first tubes; a corrugated fin including a first part which is interposed at upper and lower folded edge portions thereof between the first tubes, a second part which is interposed at upper and lower folded edge portions thereof between the second tubes and a third part through which the first and second parts are integrally connected; the first and second parts of the corrugated fin being formed with louvers which extend in a direction perpendicular to the upper and lower folded edge portions of the first and second parts, and the third part of the corrugated fin being formed with louvers which extend in a direction perpendicular to the upper and lower folded edge portions of the first and second parts, each of the louvers being of a half-louver type including an elongate flat portion which is bent up or down along a longer edge thereof from a major portion of the third part and two generally triangular supporting portions which support longitudinal ends of the elongate flat portion from the major portion.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, embodiments of the present invention will be described in detail with reference to the accompanying drawings.

For ease of understanding, various directional terms, such as, right, left, upper, lower, rightward and the like are used in the following description. However, such terms are to be understood with respect to a drawing or drawings on which corresponding part or portion is illustrated. Throughout the specification, substantially same parts and portions are denoted by the same numerals.

Figure 1:
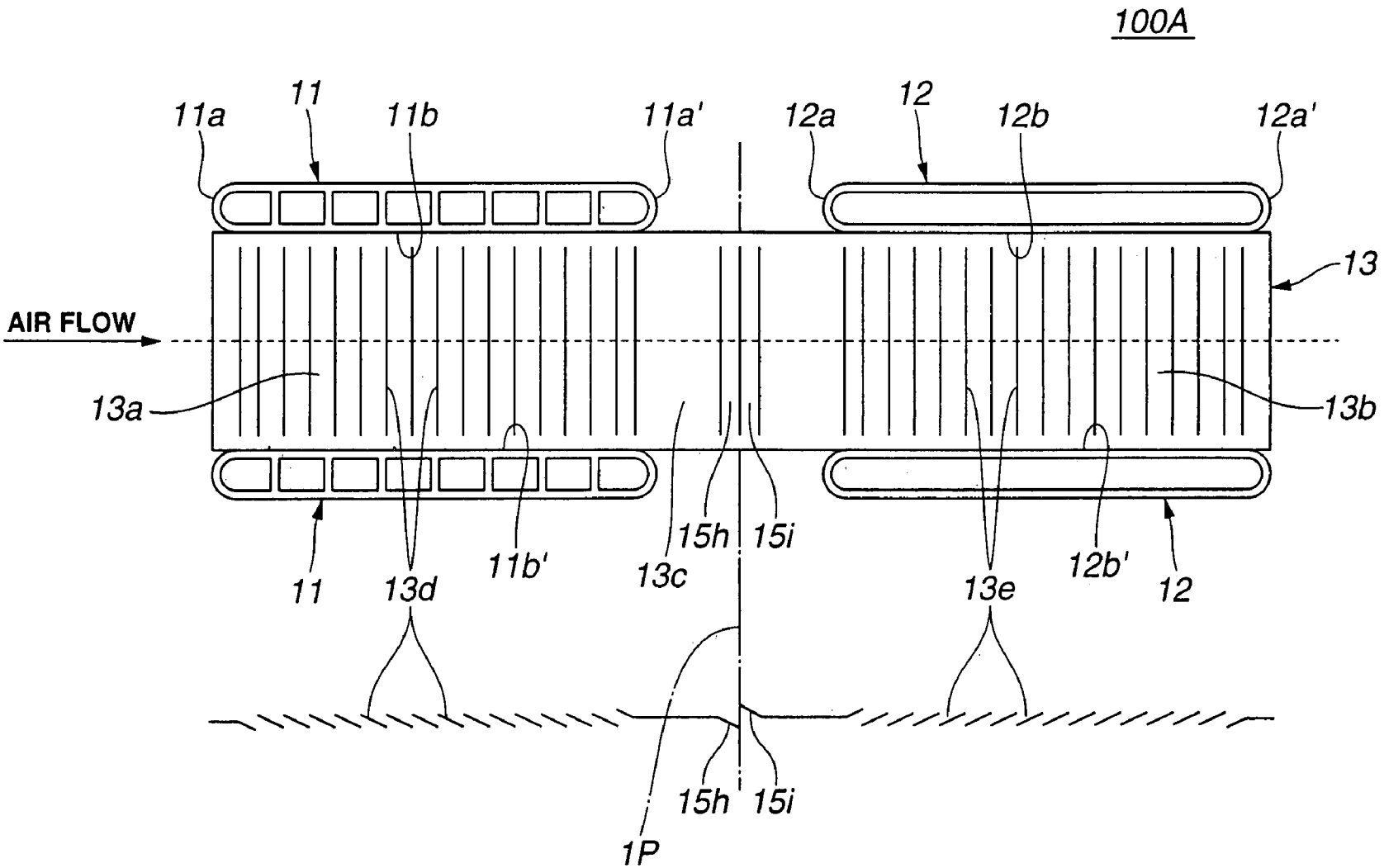
FIG. 1 is a sectional view of a core structure of an integral heat-exchanger, which is a first embodiment of the present invention.
Figure 2:
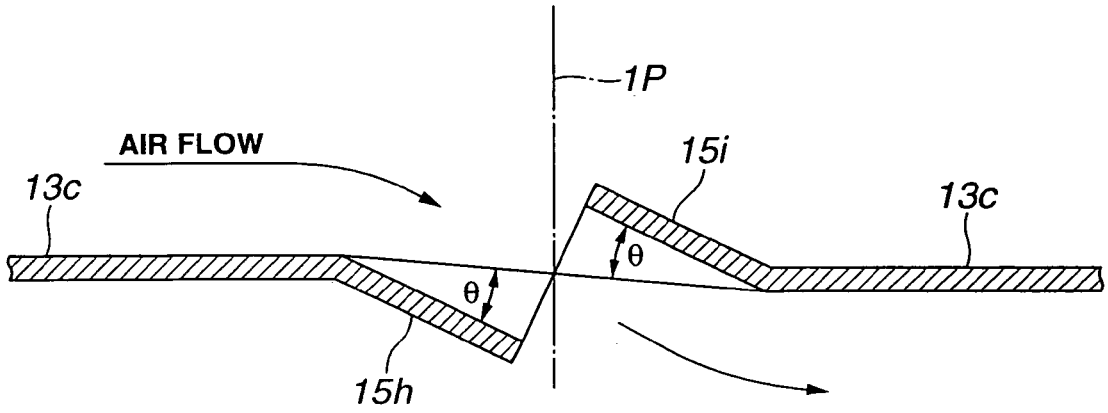
FIG. 2 is an enlarged sectional view of the core structure of the first embodiment, showing an essential part of the core structure.
Figure 3:
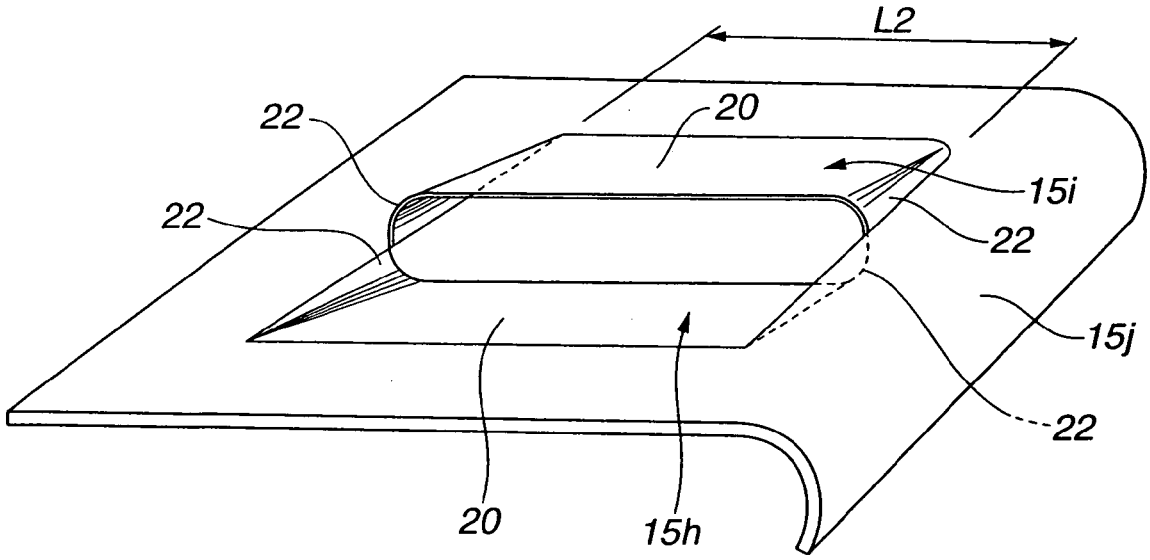
FIG. 3 is an enlarged perspective view of louvers possessed by the core structure of the first embodiment.

Referring to FIGS. 1 to 3, there is shown a core structure 100A of an integral heat-exchanger, which is a first embodiment of the present invention.

As is seen from FIG. 1, the core structure 100A comprises first parallel flat tubes 11 (only two are shown), second parallel flat tubes 12 (only two are shown) which are positioned behind the first tubes 11 and a plurality of corrugated fins 13 (only one is shown) each of which comprises a front part 13*a* interposed at upper and lower folded edge portions thereof between paired two of the first tubes 11, a rear part 13*b* interposed at upper and lower folded edge portions thereof between paired two of the second tubes 12 and a center part 13*c* through which the front and rear parts 13*a* and 13*b* are integrally connected. When in use, the first tubes 11 are positioned in front of the second tubes 12 with respect to the running air flow. The first tubes 11 are those through which a refrigerant running in a cooling system of an automotive air conditioner flows and the second tubes 12 are those through which an engine cooling water from a water jacket of an associated engine flows. Usually, the second tubes 12 are much heated as compared with the first tubes 11. The first and second tubes 11 and 12 are the same in shape and size, and the front and rear parts 13*a* and 13*b* of each corrugated fin 13 are the same in size.

The first and second tubes 11 and 12 are each constructed of an aluminum plate. As shown, each tube 11 or 12 is formed with rounded front and rear edges 11*a* and 11*a'* (or 12*a* and 12*a'*). The thickness of each tube 11 or 12 is about 1.7 mm.

The corrugated fins 13 are each constructed of an aluminum plate. Each corrugated fin 13 has an upper group of folded edge portions which are welded to inner surfaces 11*b* and 12*b* of the upper ones of the first and second tubes 11 and 12 and a lower group of folded edge portions which are welded to inner surfaces 11*b'* and 12*b'* of the lower ones of the first and second tubes 11 and 12.

The front and rear parts 13*a* and 13*b* of each corrugated fin 13 are each formed with a plurality of louvers 13*d* or 13*e* whose pitch is about 1 mm. The louvers 13*d* and 13*e* extend in a direction perpendicular to the direction in which the running air flow advances, and the louvers 13*d* and 13*e* have each both ends terminating at positions near the first and second tubes 11 and 12. The number of the louvers 13*d* of the front part 13*a* is the same as those of the louvers 13*e* of the rear part 13*b*. Thus, the front and rear parts 13*a* and 13*b* are symmetric with respect to an imaginary plane "IP" which perpendicularly passes through a center line of the corrugated fin 13.

The center part 13*c* of the corrugated fin 13 is formed with first and second half-type louvers 15*h* and 15*i* which are arranged in front of and behind the imaginary plane "IP".

As is seen from FIG. 2, the first louver 15*h* is bent downward from a major flat portion of the center part 13*c* of the corrugated fin 13, while the second louver 15*i* is bent upward from the major flat portion. As shown, the first and second louvers 15*h* and 15*i* are at the same angles "θ" with the major flat portion of the center part 13*c*. However, if desired, the angles may be different. The length of the first and second louvers 15*h* and 15*i* is substantially the same as that of the louvers 13*d* and 13*e* of the front and rear parts 13*a* and 13*b*.

In the first embodiment 100A, the first and second louvers 15*h* and 15*i* can have a sufficient length "L2" (see FIG. 3) for obtaining a satisfied obstruction of the heat transfer between the first and second tubes 11 and 12 for the reason which will be described in the following.

The first and second louvers 15*h* and 15*i* are produced by punching a corresponding part (viz., center part 13*c*) of the corrugated fins 13. With this punching, the corresponding part is cut and partially raised up from the major flat potion of the center part 13*c*.

As is seen from FIG. 3, each of the first and second louvers 15*h* and 15*i* thus produced comprises an elongate flat portion 20 which is bent downward or upward along one longer edge from the major flat portion of the center part 13*c* of the corrugated fin 13 and two generally triangular supporting portions 22 which support longitudinal ends of the elongate flat portion 20 from the major flat portion. As has been mentioned hereinabove, due to the nature of the punching, the two supporting portions 22 are produced by being considerably expanded. However, in the first embodiment 100A, the size of each triangular supporting portion 22 is generally half of that of the rectangular supporting portion 3*i* of the related art of FIG. 8, which means that, upon punching, a portion which is to be formed into the triangular supporting portion 22 is not so severely expanded as compared with the rectangular supporting portion 3*i*. Thus, in the first embodiment 100A, the supporting portions 22 can be positioned considerably close to the folded edge portions 15*j* of the corrugated fin 13, which means permission of elongation, viz., sufficient length "L2", of the first and second louvers 15*h* and 15*i*.

In operation of the core structure 100A, the refrigerant from the cooling system of the air conditioner is led into the first tubes 11 and the cooling water from the water jacket of the associated engine is led into the second tubes 12. The heat of the refrigerant and water is transferred to the corrugated fins 13 from the first and second tubes 11 and 12 and radiated to the outside air from the fins 13. Due to provision of the louvers 13*d* and 13*e* on the fins 13, heat radiation surface of the fins 13 is increased and thus the heat radiation from the fins 13 is effectively made. Furthermore, when, due to running of the vehicle, the core structure 100A receives the running air flow, the heat radiation is much effectively carried out.

Due to provision of the first and second half-type louvers 15*h* and 15*i* in the center part 13*c* of each corrugated fin 13, the heat transfer between the front and rear parts 13*a* and 13*b* of the fin 13 is obstructed or at least minimized. As has been mentioned hereinabove, since the first and second half-type louvers 15*h* and 15*i* have a sufficient length "L2", the heat transfer obstruction is effectively made. As is easily understood from FIG. 2, the first and second half-type louvers 15*h* and 15*i* are constructed to smoothly introduce and run out the running air flow, and thus provision of such louvers 15*h* and 15*i* does not induce an increase in air flow resistance of the core structure 100A. A test has revealed that the heat transfer obstruction made by the louvers 15*h* and 15*i* is larger than that of the parallel louvers 3*e* of the related art (see FIG. 8) by about 50%.

Figure 4:
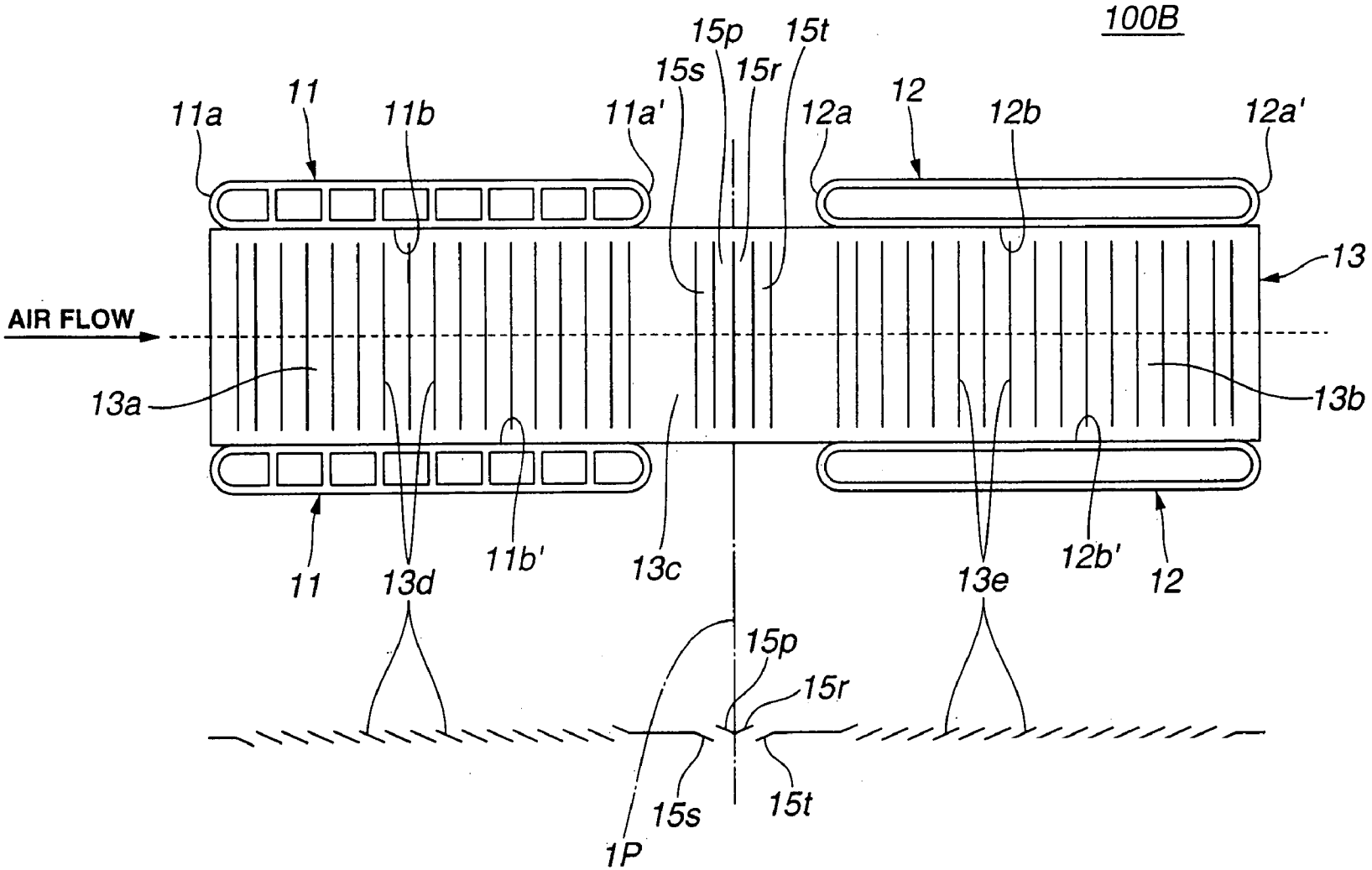
FIG. 4 is a view similar to FIG. 1, but showing a core structure of a second embodiment of the present invention.
Figure 5:
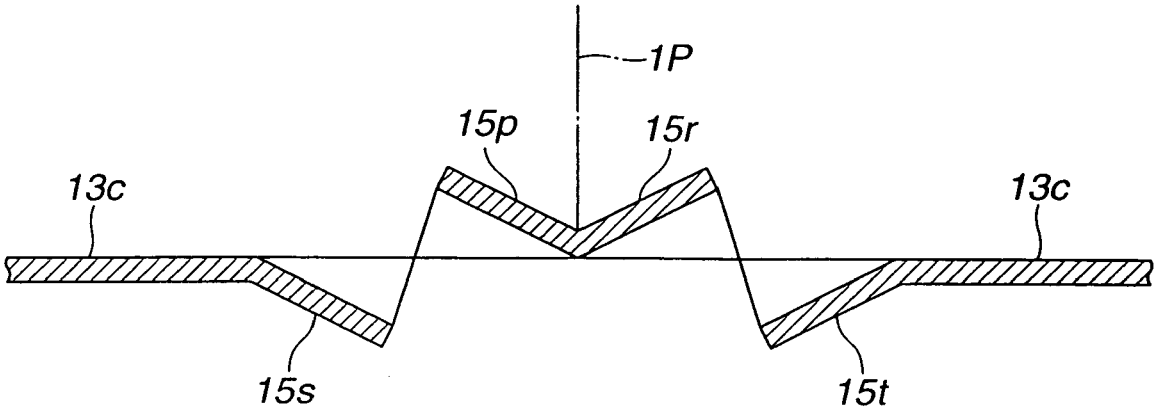
FIG. 5 is an enlarged sectional view of the core structure of the second embodiment, showing an essential part of the core structure.
Figure 6:
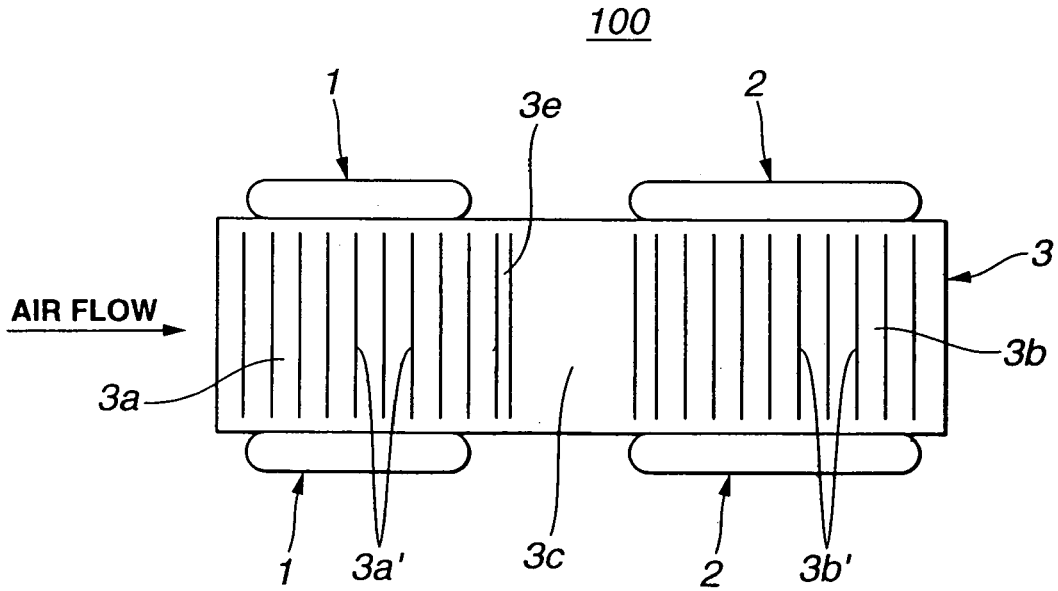
FIG.6 (RELATED ART)
FIG. 6 is a view similar to FIG. 1, but showing a core structure of a related art.
Figure 7:
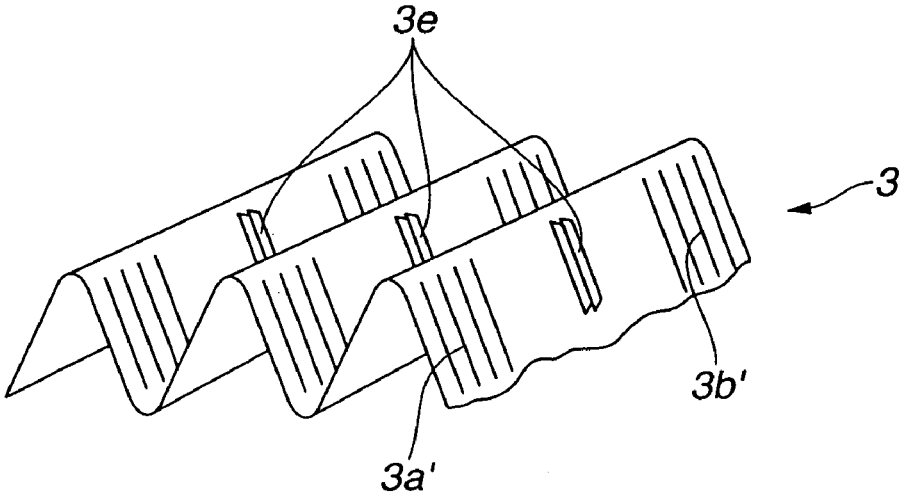
FIG.7 (RELATED ART)
FIG. 7 is a partial perspective view of a corrugated fin employed in the core structure of the related art.

Referring to FIGS. 4 and 5, there is shown a core structure 100B of an integral heat-exchanger, which is a second embodiment of the present invention.

Since the second embodiment 100B is similar to the above-mentioned first embodiment 100A, only parts or portions which are different from those of the first embodiment 100A will be described in detail in the following.

That is, in this second embodiment 100B, a center part 113*c* is different from the center part 13*c* of the first embodiment 100A.

The center part 113*c* of the corrugated fin 13 is formed with first, second, third and fourth half-type louvers 15*s*, 15*p*, 15*r* and 15*t* which are arranged in order with respect to the direction of the running air flow.

As is seen from FIG. 5, a unit including the first and second louvers 15*s* and 15*p* and the other unit including the third and fourth louvers 15*r* and 15*t* are symmetrically arranged with respect to the imaginary plane "IP". More specifically, the first and second louvers 15*s* and 15*p* are substantially the same as the above-mentioned first and second louvers 15*h* and 15*i* of the first embodiment 100A, while the third and fourth louvers 15*r* and 15*t* are reversed in construction to the first and second louvers 15*s* and 15*p* with respect to the imaginary plane "IP".

For the reasons which have been described hereinabove, the first, second, third and fourth half-type louvers 15*s*, 15*p*, 15*r* and 15*t* can each have a sufficient length "L2". Thus, also in this second embodiment 100B, the heat transfer between the front and rear parts 13*a* and 13*b* of the corrugated fin 13 is effectively obstructed. Furthermore, in this second embodiment 100B, the symmetric arrangement between the unit of first and second louvers 15*h* and 15*i* and the other unit of third and fourth louvers 15*r* and 15*t* reduces or at least minimizes undesired curving of the corrugated fin 13 which would be produced upon punching.

Figure 8:
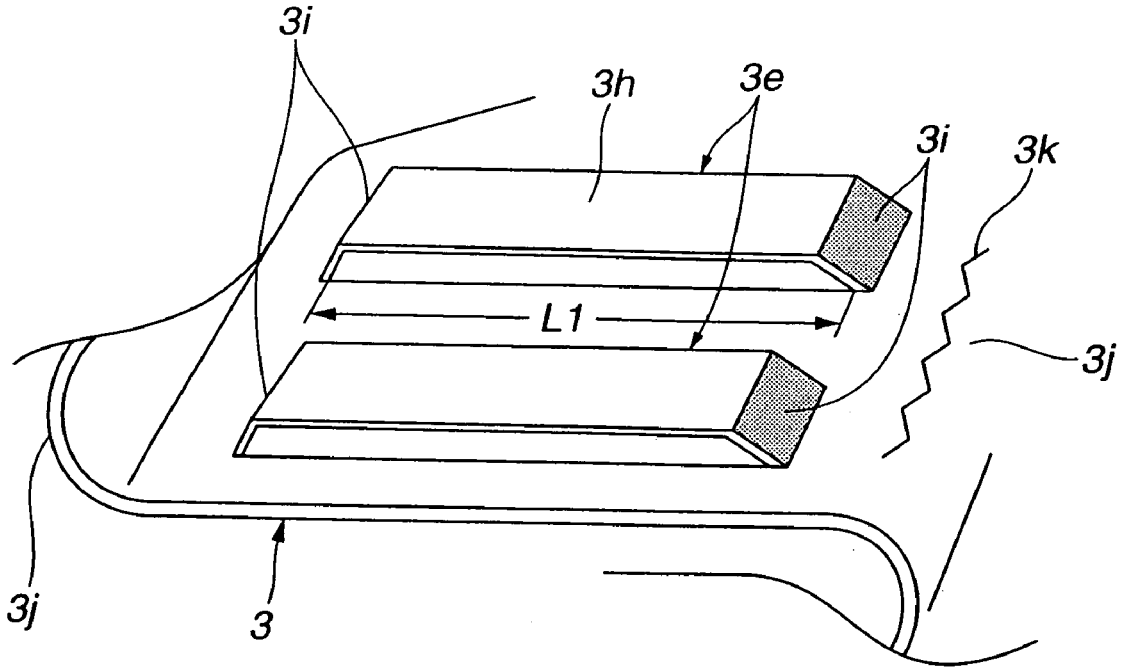
FIG.8 (RELATED ART)
FIG. 8 is an enlarged perspective view of parallel louvers possessed by the core structure of the related art.

It is to be noted that the louvers 13*d* and 13*e* formed in the front and rear parts 13*a* and 13*b* of the fin 13 may be of a parallel type which, as is seen from FIG. 8, comprises a fully raised elongate flat portion 3*h* and two generally rectangular supporting portions 3*i*.

The entire contents of Japanese Patent Application 2001-75469 filed Mar. 16, 2001 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A core structure of an integral heat-exchanger, comprising:

at least two first tubes which extend in parallel with each other;

at least two second tubes which extend in parallel with each other, said second tubes being juxtaposed with said first tubes; and a corrugated fin including a first part which is interposed at upper and lower folded edge portions thereof between said first tubes, a second part which is interposed at upper and lower folded edge portions between said second tubes and a third part through which said first and second parts are integrally connected, wherein said third part of said corrugated fin is formed with louvers which extend in a direction perpendicular to the upper and lower folded edge portions of said first and second parts, each of said louvers being of a half-louver type including an elongate flat portion which is bent up or down along a longer edge thereof from a major portion of said third part and two generally triangular supporting portions which support longitudinal ends of said elongate flat portion from said major portion, wherein one of said louvers comprises an elongate flat portion which is bent upward from said major portion and two generally triangular supporting portions which support longitudinal ends of said elongate flat portion from said major portion and in which the other of said louvers comprises an elongate flat portion which is bent downward from said major portion and two generally triangular supporting portions which support longitudinal ends of said elongate flat portion from said major portion, and wherein said louvers of said third part of said corrugated fin comprises:

a first louver which is bent downward along a longer edge thereof from said major portion;

a second louver which is bent upward along a longer edge thereof from said major portion;

a third louver which is bent upward along a longer edge thereof from said major portion; and a fourth louver which is bent downward along a longer edge thereof from said major portion, wherein a unit including said first and second louvers and another unit including said third and fourth louvers are symmetrically arranged with respect to an imaginary plane which is perpendicular to a center line of said corrugated fin, and wherein said second louver and said third louver are immediately adjacent each other and are arranged between said first louver and said fourth louver.

2. A core structure as claimed in claim 1, in which said two generally triangular supporting portions are those which have been subjected to an expansion when punched.

3. A core structure as claimed in claim 1, in which said first and second parts of said corrugated fin are formed with a plurality of louvers which extend in a direction perpendicular to the upper and lower folded edge portions of said first and second parts.

4. A core structure of an integral heat-exchanger, comprising:

at least two flat first tubes which extend in parallel with each other;

at least two flat second tubes which extend in parallel with each other, said second tubes being juxtaposed with said first tubes;

a corrugated fin including a first part which is interposed at upper and lower folded edge portions thereof between said first tubes, a second part which is interposed at upper and lower folded edge portions thereof between said second tubes and a third part through which said first and second parts are integrally connected; and said first and second parts of said corrugated fin being formed with louvers which extend in a direction perpendicular to the upper and lower folded edge portions of said first and second parts, wherein said third part of said corrugated fin is formed with louvers which extend in a direction perpendicular to the upper and lower folded edge portions of said first and second parts, each of said louvers being of a half-louver type including an elongate flat portion which is bent up or down along a longer edge thereof from a major portion of said third part and two generally triangular supporting portions which support longitudinal ends of said elongate flat portion from said major portion, wherein said louvers of said third part of said corrugated fin comprises:

a first louver which is bent downward along a longer edge thereof from said major portion;

a second louver which is bent upward along a longer edge thereof from said major portion;

a third louver which is bent upward along a longer edge thereof from said major portion; and a fourth louver which is bent downward along a longer edge thereof from said major portion, wherein a unit including said first and second louvers and another unit including said third and fourth louvers are symmetrically arranged with respect to an imaginary plane which is perpendicular to a center line of said corrugated fin, and wherein said second louver and said third louver are immediately adjacent each other and are arranged between said first louver and said fourth louver.

5. A core structure as claimed in claim 1, wherein said second louver and said third louver physically contact each other, and wherein each of the second louver and the third louver is bent upward along an entire longer edge thereof.

6. A core structure as claimed in claim 4, wherein said second louver and said third louver physically contact each other, and wherein each of the second louver and the third louver is bent upward along an entire longer edge thereof.

* * * * *